US006289822B1

(12) United States Patent
Black, Jr. et al.

(10) Patent No.: US 6,289,822 B1
(45) **Date of Patent: *Sep. 18, 2001**

(54) AUTO RACK RAILWAY CAR

(75) Inventors: James E. Black, Jr., Trenton, MI (US); Andrew B. Eaker, Kennesaw; Mark L. Litherland, Atlanta, both of GA (US); Michael J. Rench, Wyandotte, MI (US); James C. Robertson; Ralph H. Schorr, both of Lawrenceville, GA (US)

(73) Assignee: Thrall Car Manufacturing Company, Chicago Heights, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/084,802

(22) Filed: May 26, 1998

Related U.S. Application Data

(63) Continuation of application No. 08/558,488, filed on Nov. 16, 1995, now Pat. No. 5,765,486.

(51) Int. Cl.[7] ..... B61D 17/00
(52) U.S. Cl. ..... 105/410; 105/283; 105/284
(58) Field of Search ..... 105/280, 283, 105/284, 18, 355, 404, 409, 421, 458, 1.2; 296/146.1, 146.8; 16/366, 367

(56) References Cited

U.S. PATENT DOCUMENTS

| | | | | |
|---|---|---|---|---|
| 1,535,799 | * | 4/1925 | Adams | 105/4.1 |
| 3,995,563 | * | 12/1976 | Blunden | 49/370 |
| 4,092,044 | * | 5/1978 | Hoffman | 298/27 |
| 4,343,401 | * | 8/1982 | Paulyson | 105/375 |
| 4,936,227 | * | 6/1990 | Bauer | 49/41 |
| 5,033,395 | | 7/1991 | Bechu et al. . | |
| 5,060,578 | | 10/1991 | Carimentrand . | |
| 5,349,782 | * | 9/1994 | Yulkowski . | |
| 5,527,139 | * | 6/1996 | Bruder | 410/112 |

FOREIGN PATENT DOCUMENTS

2202889 * 10/1988 (GB) ..... 105/400

OTHER PUBLICATIONS

Three photographs of "Trailer Train Company Prototype 156' Articulated Bi–Level Auto Rack Car" (undated).

Information Sheet entitled "Trailer Train Company Prototype 156' Articulated Bi–Level Auto Rack Car" Photograph of Safe–Pak Car.

Progressive Railroading, Dec. 1998, pp. 40–41.

Railway Age, Mar. 1999, pp. 30–31.

Progressive Railroading's 1996–1997 Car & Locomotive Yearbook and Buyers' Guide, 1996, pp. 5, 24, and 64.

The Car and Locomotive Cyclopedia of American Practices, Sixth Edition, 1997, pp. 7–20.

Whitehead & Kales Company, Drawing No. A 239–241, Dec. 16, 1972.

* cited by examiner

*Primary Examiner*—Christopher P. Schwartz
*Assistant Examiner*—C. T. Bartz
(74) *Attorney, Agent, or Firm*—Fitch, Even, Tabin & Flannery

(57) ABSTRACT

A railway car for transportation of motor vehicles. The railway car may be articulated, comprising two or more units. The railway car may have end doors which are pivotally attached to the roof of the railway car. Flexible seals may be provided along the inner and outer edges of the end doors. Ventilation in the side walls of the railway car may be provided by small diameter perforations grouped at elevations near the top and bottom of each level. The side walls may be constructed by a combination of load bearing side wall panels which function as shear plates, and vertical posts. Protection for the door edges of motor vehicles being carried in the railway car may be provided by providing a plurality of parallel horizontal strips of a relatively soft material along the inside of each side wall on each level. A flexible enclosure may be provided between adjacent car units. A heat-reflecting corrosion-resistant coating may be provided on the galvanized steel corrugated roof to extend the life of the roof.

7 Claims, 9 Drawing Sheets

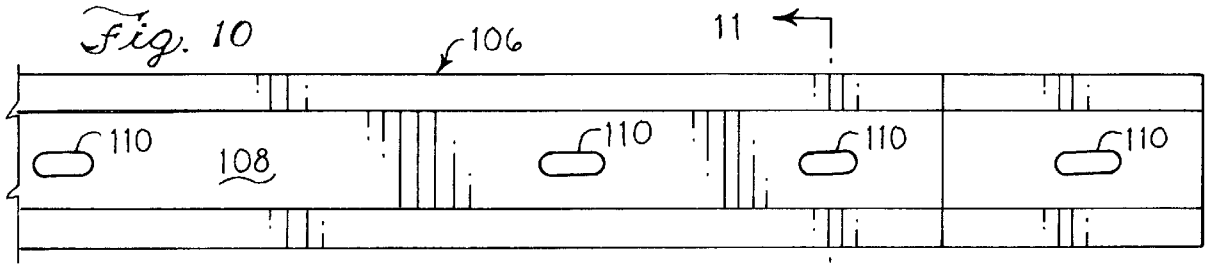
Fig. 10
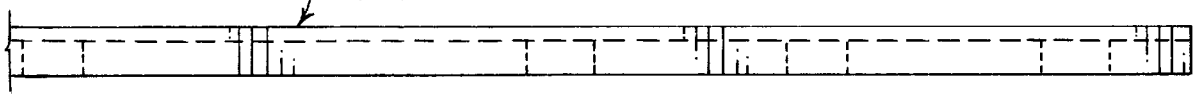
Fig. 11
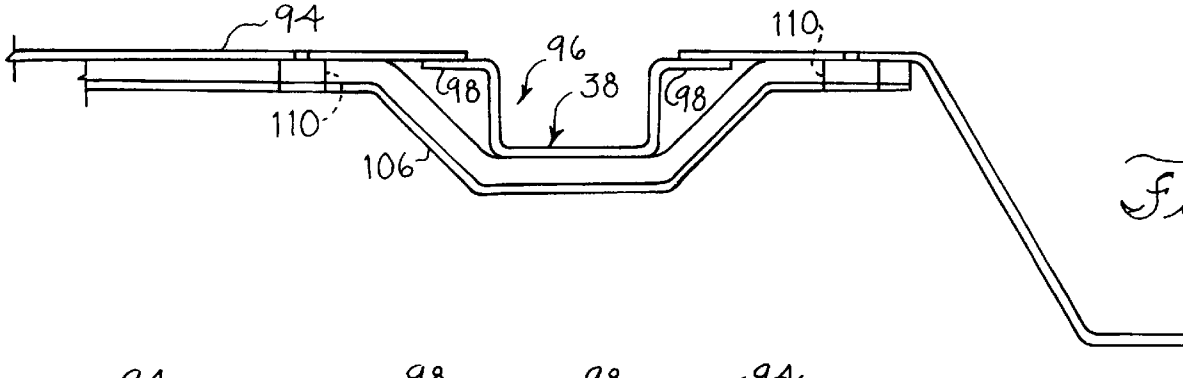
Fig. 12
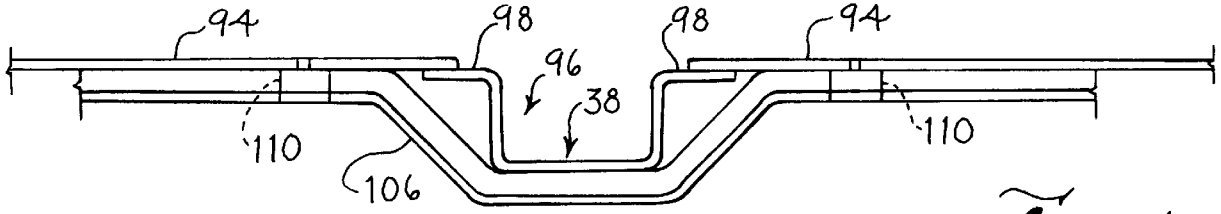
Fig. 13
Fig. 14

AUTO RACK RAILWAY CAR

This is a continuation, of prior application Ser. No. 08/558,488, filed Nov. 16, 1995, now U.S. Pat. No. 5,765,486, which is hereby incorporated herein by reference in its entirety.

BACKGROUND OF THE INVENTION

The invention relates generally to railway cars, and more particularly to a railway car for carrying automotive vehicles.

One problem addressed by the invention is to reduce the quantities of dust, metal particles, and other airborne contaminants that may be admitted to the interior of the car through the gaps and perforations in the sides and ends of the cars. Conventional doors do not completely enclose the ends. It has been estimated that in a typical conventional auto rack car, over 6 percent of the end area is open.

To prevent accumulation of unacceptable levels of automobile exhaust gases in the railway car interior as a result of operation of automobile engines during loading and unloading operations and to admit light, it is generally thought to be desirable that openings be provided in the side walls of the car. Conventional auto rack cars widely used in the United States, Canada and Mexico at present typically have side wall panels which are perforated, and which are separated from each other and from adjacent structural components by gaps. It has been estimated that about 18 percent of side surface area is open in most auto racks.

It is a general object of the invention to provide a railway car for carrying automobiles which provides adequate ventilation without permitting unacceptably high inflow of particulates.

Another problem addressed by the invention is to improve security. While the side panels and doors on conventional auto racks provide a reasonable degree of security, unauthorized persons may nevertheless gain entry to conventional cars using crowbars or the like to widen gaps between doors and/or other structural components.

Another problem addressed by the invention is to provide an interior with fewer obstructions. Clearance is needed to permit the doors of vehicles to be opened to permit drivers to enter and exit in the course of loading and unloading operations. In conventional auto rack cars, internal knee braces and gussets may, to some extent, restrict opening of automobile doors and workers in the car interior. Another problem addressed by the invention is to provide an economical way to reduce potential damage to vehicle doors caused by accidental contact between the vehicle doors and interior side wall components of the railway car when the vehicle doors are opened.

Another problem addressed by the invention is to increase the life of the corrugated galvanized steel roofs which are used on railway cars for carrying motor vehicles. While the use of galvanized steel provides a significant advantage over the use of uncoated steel, it is a general object of the invention to further increase the roof life.

SUMMARY OF THE INVENTION

In accordance with one aspect of the invention, there is provided a railway car for transportation of motor vehicles which has improved end doors. The end doors may be improved both with respect to reduction of inflow of airborne contaminants through the ends of the car and with respect to improved security by providing upper portions on the doors which partially overlie portions of the roof of the railway car, and which may be pivotally connected to the roof. Flexible seals may be provided along the inner and outer edges of the end doors.

In accordance with another aspect of the invention, ventilation in the side walls of the railway car may be provided by small diameter perforations, grouped at elevations near the top and bottom of each level, with remaining portions of the side walls being imperforate, thereby providing sufficient passive light and ventilation for the interior of the railway car, while substantially reducing admission of airborne particulates as compared with prior auto rack railway cars.

In accordance with a further aspect of the invention, internal obstructions may be reduced by the use of a "clean bore" interior design, wherein obstructions in the car interior are reduced or eliminated by employing load-bearing side walls having structural components which are positioned to avoid protruding unnecessarily into the car interior. To this end, load bearing shear plates may be used as side wall panels for the car.

In accordance with a further aspect of the invention, protection for the doors of automobiles carried in the railway car may be provided on each level of the railway car by a plurality of door edge protection strips of a resilient material attached in parallel to one another and vertically spaced from one another along the inside of each side wall. The door edge protection strips may be positioned at a range of elevations on each level to enable them to absorb impacts from doors of vehicles of various sizes ranging from small compact automobiles to large sport utility vehicles.

In accordance with another aspect of the invention, a protective, corrosion resistant coating may be provided on a galvanized steel corrugated roof to extend the life of the roof. A coating may be applied on both the interior and exterior of the roof.

In accordance with a further aspect of the invention, a flexible enclosure may be provided to enclose the space between car units in an articulated railway car. The enclosure may be made of a flexible, resilient elastomeric material or the like, and may have internal reinforcement provided by a wire mesh or by other reinforcing material to provide resistance to cutting for improved security.

Additional features and advantages of the invention are disclosed in the detailed description of the preferred embodiment and in the accompanying drawings.

BRIEF DESCRIPTION OF THE DRAWINGS

FIG. 10 is an enlarged elevational view of one of the door edge protectors shown in FIG. 9;

FIG. 11 is a sectional elevational view taken substantially along line 11—11 in FIG. 10;

FIG. 12 is a bottom view of the door edge protection device of FIG. 10;

FIG. 13 is a sectional view taken substantially along line 13—13 in FIG. 9; and FIG. 14 is a sectional view taken substantially along line 14—14 in FIG. 9.

DETAILED DESCRIPTION OF PREFERRED EMBODIMENT

Figure 1:
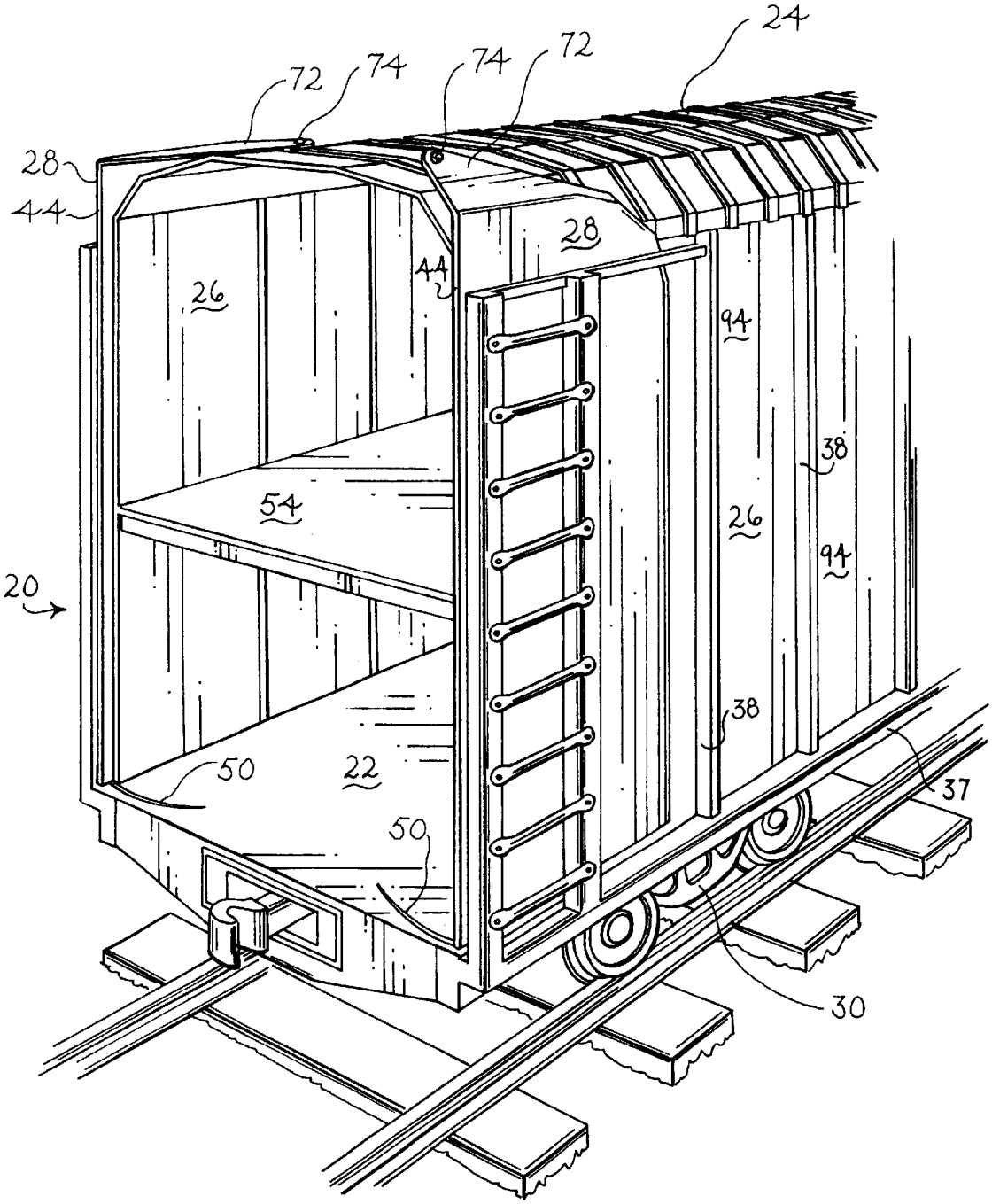
FIG. 1 is a perspective view of one end of a railway car in accordance with the invention.

The invention is generally embodied in a railway car for transporting automobiles. The railway car may comprise one or more units. In the illustrated embodiment, the railway car is articulated, comprising a pair of substantially identical units 20 joined at a single articulation. The invention may alternatively be embodied in an articulated car comprising three or more units, or may be embodied in a non-articulated car consisting of a single unit.

In the illustrated embodiment, each car unit generally comprises a floor 22, a roof 24, a pair of upstanding side walls 26, and a pair of end doors 28 at each end of the car. An end truck 30 is positioned near each end of the car, and a shared central truck 32 is positioned beneath the articulation.

Each unit has a center sill 34 extending longitudinally beneath the car body. A plurality of transverse cross bearers are disposed at spaced locations along the center sill. A pair of side sills 37 extend longitudinally along the bottom of the side walls, joining the ends of the cross bearers, and a plurality of substantially vertical posts 38 extend upward from the side sills at the ends of the cross bearers.

End Doors

Each of the illustrated end doors 28 preferably includes a substantially vertical panel 40 which extends from the floor to the roof, and a pair of rollers 42 disposed at the bottom of the panel for movably supporting the door. The doors have gasket seal members 76 at their inner edges 44 which meet at the center of the car when the doors are closed. Each door has a generally planar inner portion 46, and has an outer portion 48 which is curved somewhat toward the car interior.

The end doors 28 are movable between a closed position in which their inner edge seal members 76 are in contact with one another, and an open position in which the doors are positioned on opposite sides of the end opening of the car, with their inner edges 44 disposed directly adjacent the opening. A substantial portion of the weight of each door in the preferred embodiment is carried by the rollers 42 at the bottom of the door which travel on an arcuate lower track 50 extending along the floor 22 of the car and out along the outside of the side wall. A guide track is preferably provided underneath the upper deck 54 of the car, to guide a lock pin on the inside of the door between open and closed positions.

The lower track 50 preferably comprises a length of material having an inverted L-shaped cross section, curved substantially uniformly about a predetermined radius along its entire length. The lower track 50 is mounted directly on the upper surface of the floor plate 22. The rollers 42 roll along the upper surface of the track. An inner wall plate member 56 extends downward beyond the bottom of the rollers on the inside of the track to limit outward displacement of the bottom of the door. An outer bottom member 58 of the door extends downward beyond the bottom of the roller and has an inwardly extending flange 60 which extends under the horizontal top portion of the track to limit upward displacement of the door, and to limit inward displacement of the bottom of the door.

Figure 8A:
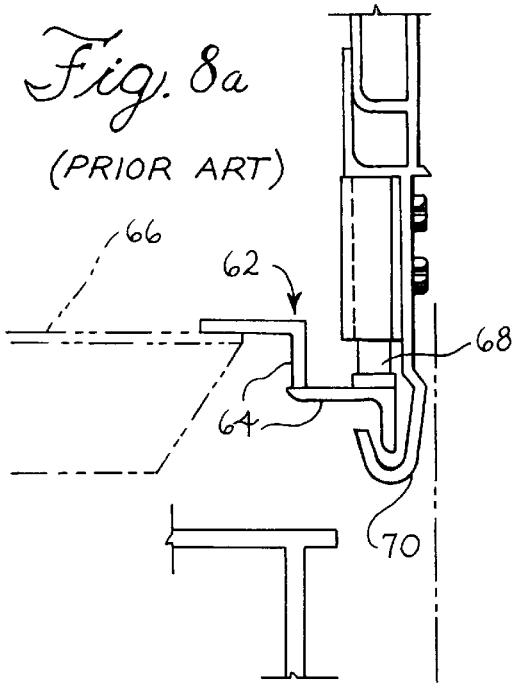
Fig. 8a (PRIOR ART)
FIG. 8A is a sectional elevational view of a prior art roller assembly.
Figure 8:
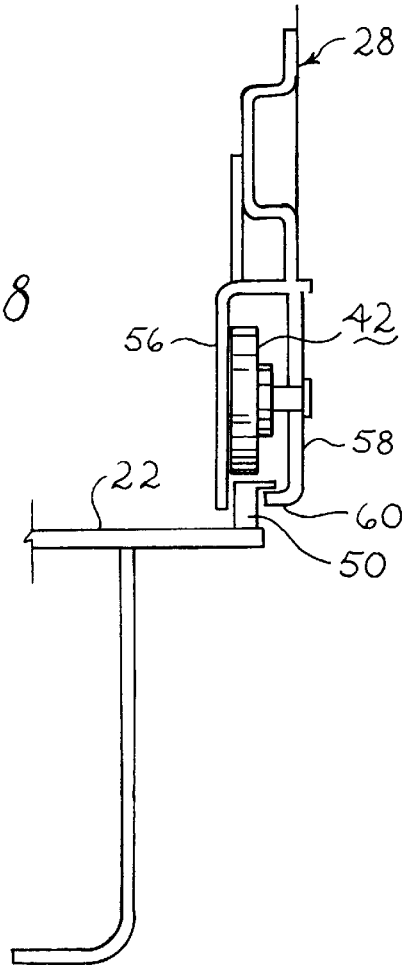
FIG. 8 is a sectional elevational view illustrating a roller assembly for one of the end doors.

A prior art track is shown in cross-section at 62 in FIG. 8A. The prior art track 62 comprises a pair of angle members 64 welded together extending outward and downward from the edge of a riser 66. In the prior art arrangement, the rollers roll on wear plates 68 affixed to the outer/bottom angle member, and a "J " plate 70 extending down around the outside of the lower angle, and up about the inside thereof, provides constraint against inward, outward, and upward movement of the bottom of the door. In the prior art arrangement of FIG. 8A, the track 62 is not provided with a constant, uniform radius along its entire length, and, accordingly, different tracks are required for the right- and left-hand sides of the car. The arrangement of FIG. 8 is believed to provide cost savings as compared with the prior art arrangement of FIG. 8A in simplifying the construction of the track, and in eliminating the need for different track elements to be used on the respective right- and left-hand sides.

Figure 2:
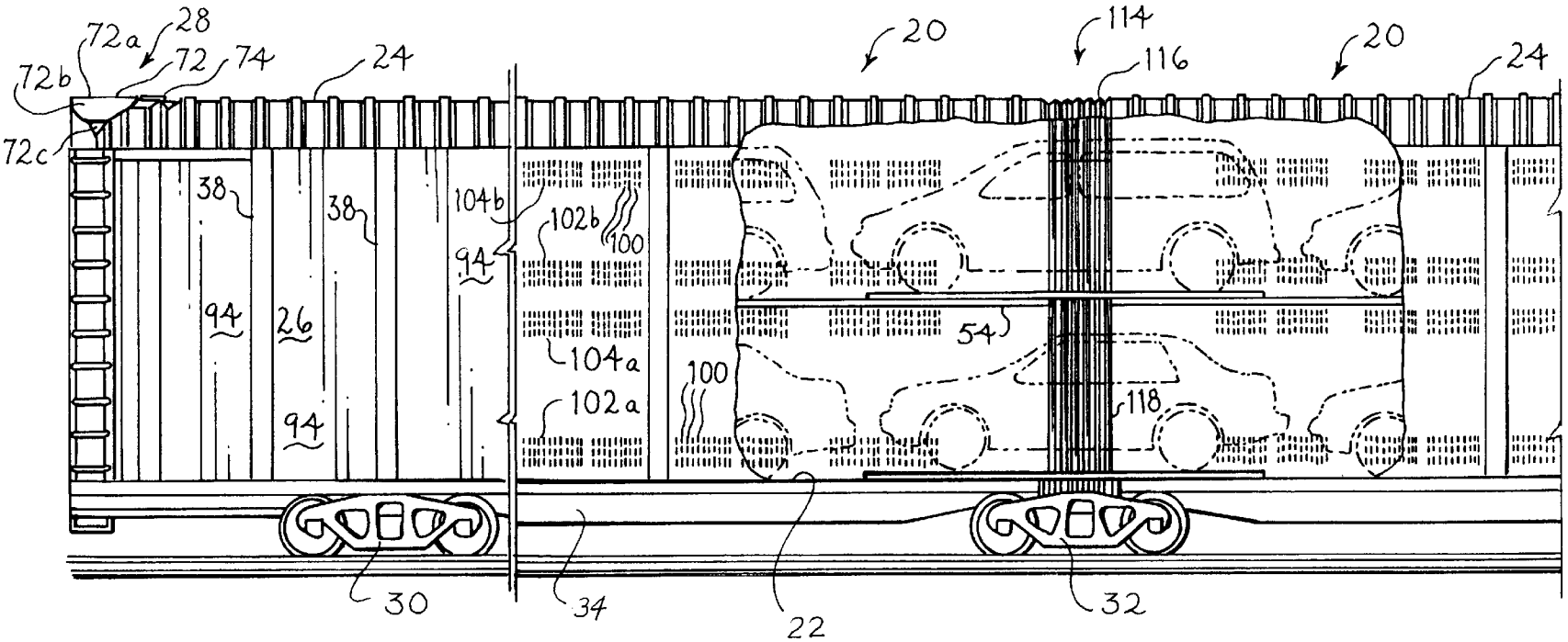
FIG. 2 is a foreshortened side elevational view of the railway car of FIG. 1.
Figure 3A:
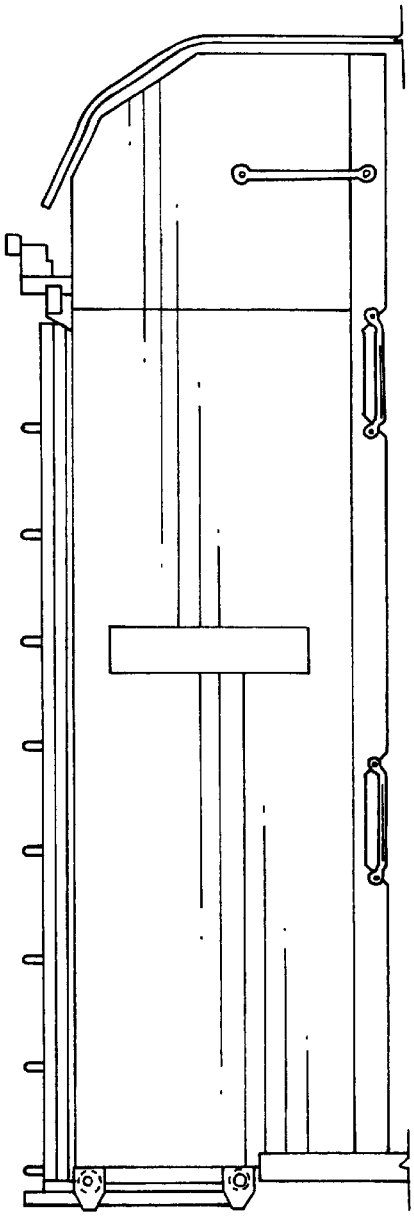
Fig. 3a (PRIOR ART)
FIG. 3A is a partial end elevational view of a prior art railway car, shown with one of the end doors in closed position.
Figure 3:
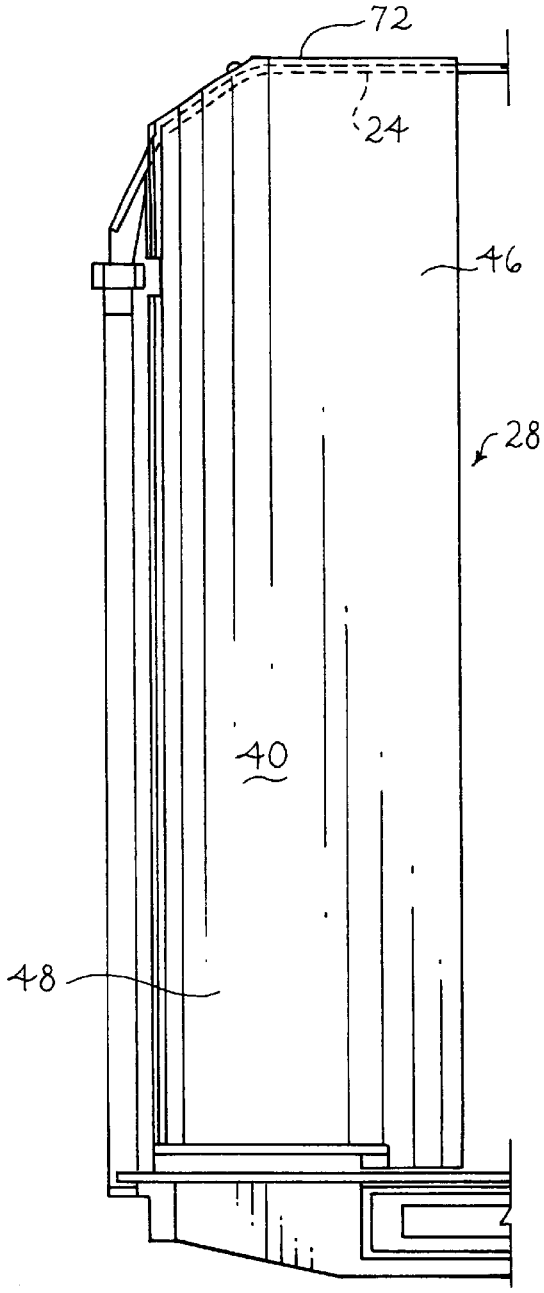
FIG. 3 is a partial end elevational view of the railway car of FIG. 1.

Referring to FIGS. 1–3, to reduce air flow into the car interior through the ends of the car, the end doors 28 in accordance with the illustrated embodiment of the invention extend above the roof at the end of the car. Each door preferably has a top portion 72 which extends generally horizontally inward in overlapping relation with the roof 24. To enable the top portion 72 to overlap the roof without exceeding the maximum permissible height for the car, the roof is depressed, i.e., offset or indexed down, at the end of the car by a distance at least equal to the vertical dimension of the top portion 72 of the door. The distance is preferably about ½ in. to 1 in., and may be equal to about ¾ in. The upper surface of the top portion 72 of the door is preferably approximately level with the top surface of the roof across its width, and comprises a substantially horizontal inner portion 72a, an intermediate portion 72b which slopes downward and outward, and an outer portion 72c which slopes more steeply downward and outward.

To improve security and to contribute to support of the end door, the top portion 72 of each of the end doors preferably is pivotally connected to the roof. If desired, a portion of the weight of the door may be carried by a bearing, bushing, or the like at the pivotal connection 74. More importantly, however, the pivotal connection 74 limits radial displacement of the door relative to its center of rotation. In particular, the pivotal connection 74 constrains the upper part of the door against outward movement. This increases the rigidity of the door in operation, reducing loads on the guide track, and additionally improves security by making it difficult or impossible for unauthorized persons to gain entry to the railway car by bending the upper portion of the door away from the roof 24. The door 28 may be contrasted with prior art doors like that shown in FIG. 3A, which leave a gap between the top of the door and the roof.

In the illustrated embodiment, the top portion 72 of the end door which overlaps the roof extends across almost the entire width of the door, so that entry of air adjacent the top portion of the door is restricted or inhibited across the entire width of the door. The door extends approximately from the center line of the car to the side wall 26 of the car. Thus, the end doors, in combination, substantially cover the entire end opening of the car.

In the preferred embodiment of the invention, the top portion 72 of each end door comprises a steel plate which is substantially solid and rigid so that it will be effective both for preventing or inhibiting entry of air into the car, and for inhibiting entry of unauthorized persons at the top of the doors. The end doors are preferably made of steel, and the top portion may be a separate steel plate or sheet which is riveted, bolted, welded, or otherwise fastened to the vertical main portion of the door. It should be appreciated that in other embodiments of the invention, the top portion may be made wholly or partially of other materials such as structural plastics or composites, or the top portion 72 might comprise a narrow arm or the like which performs only a structural function for security purposes, without significantly inhibiting entry of air.

Figure 5:
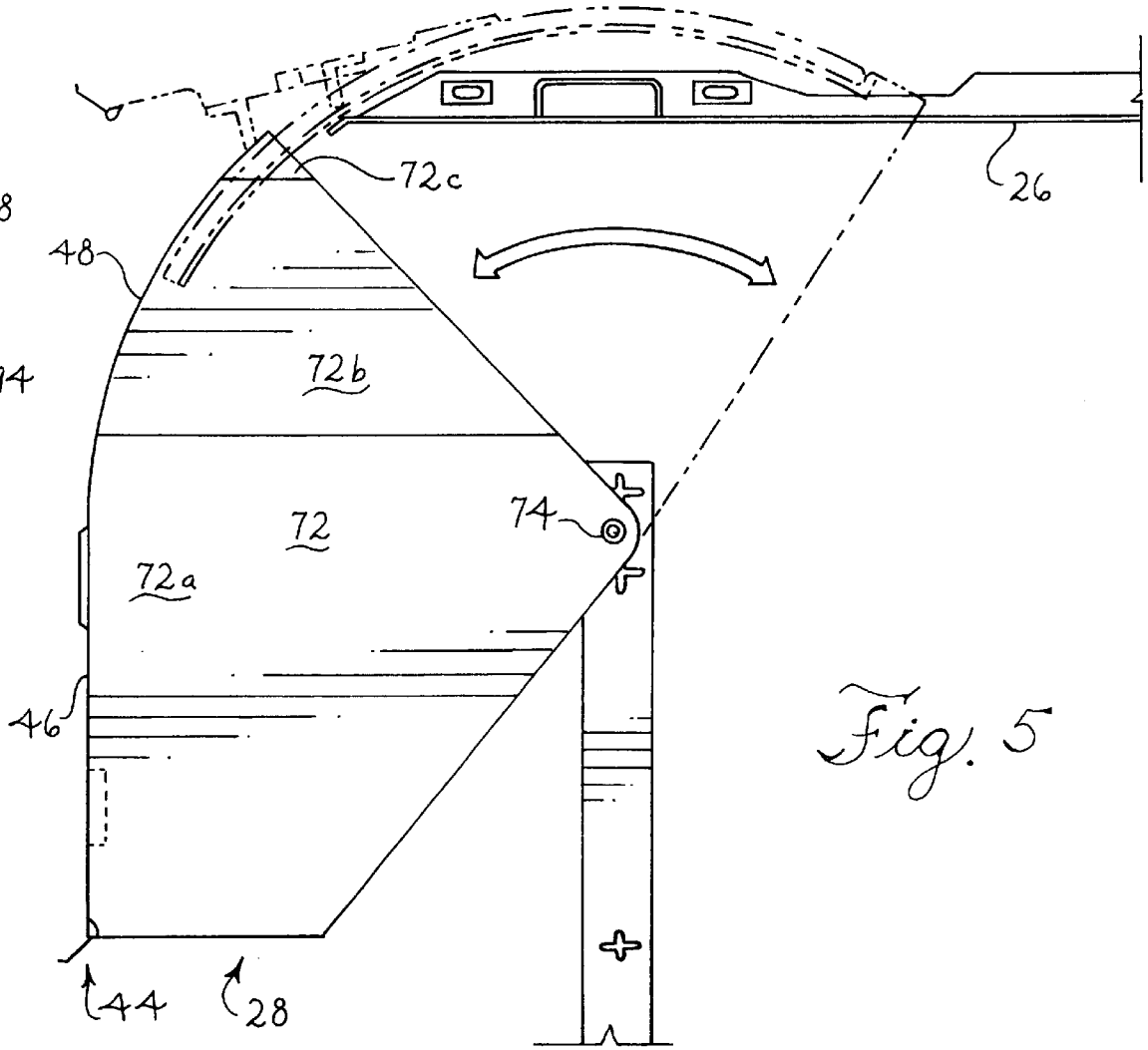
FIG. 5 is a plan view of an end door of the railway car of FIG. 1, shown in closed position, with an open position of the door illustrated in phantom.
Figure 4:
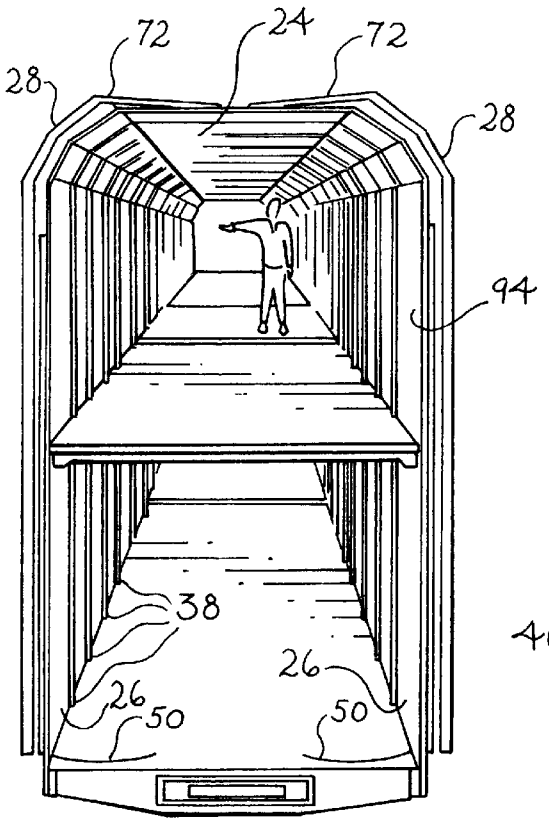
FIG. 4 is an end elevational view of the railway car of FIG. 1, with the end doors in open position.
Figure 6:
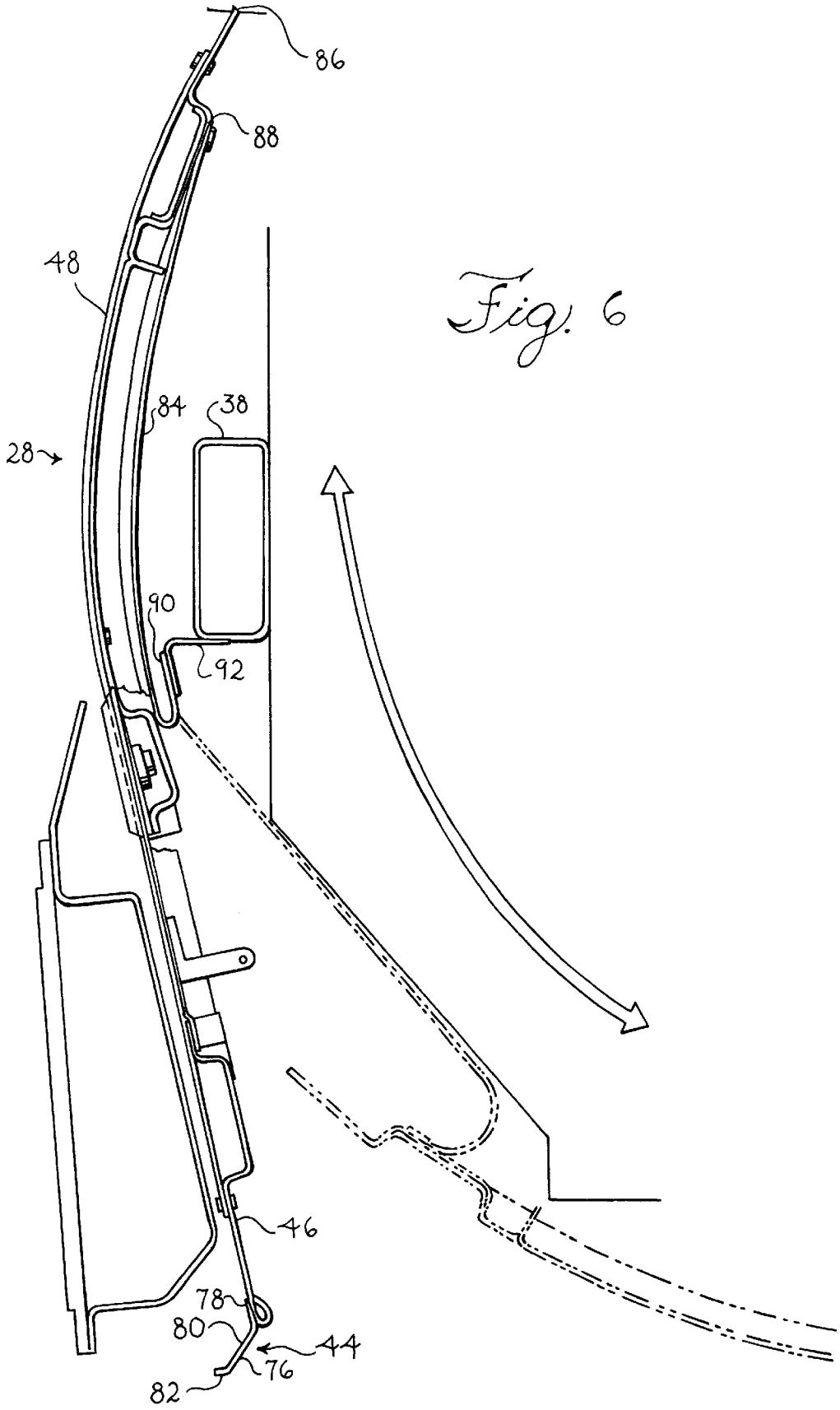
FIG. 6 is a sectional plan view illustrating one of the end doors in open position, with the door being shown in closed position in phantom.

Entry of air between the end doors is prevented or inhibited by a seal formed by adjacent seal members 76 extending along the inner edges 44 of the respective doors. Each of the illustrated seal members comprises a flange portion 78 attached to its associated door, and an extension 80 which is joined to the flange at an obtuse angle as viewed in plan. In the illustrated embodiment, each of the seal members is attached to the exterior surface of the door along the inner edge 44 of the door, and in its undeformed position, shown in FIG. 5, and shown in phantom in FIG. 7, extends outward, away from the interior of the car, and toward the opposite door. Each of the seal members 76 extends substantially the entire height of the door.

Figure 7:
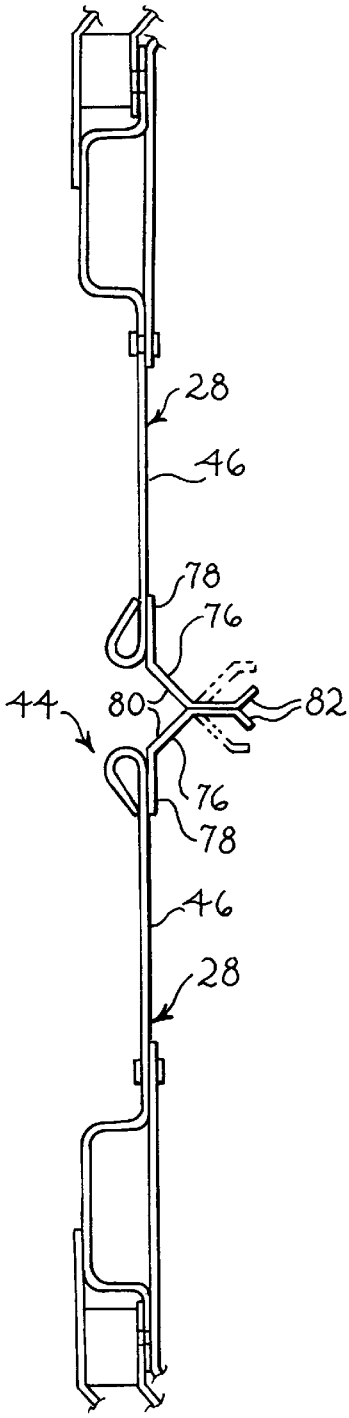
FIG. 7 is a sectional plan view illustrating inner edge portions of a pair of end doors in closed position.
Figure 9:
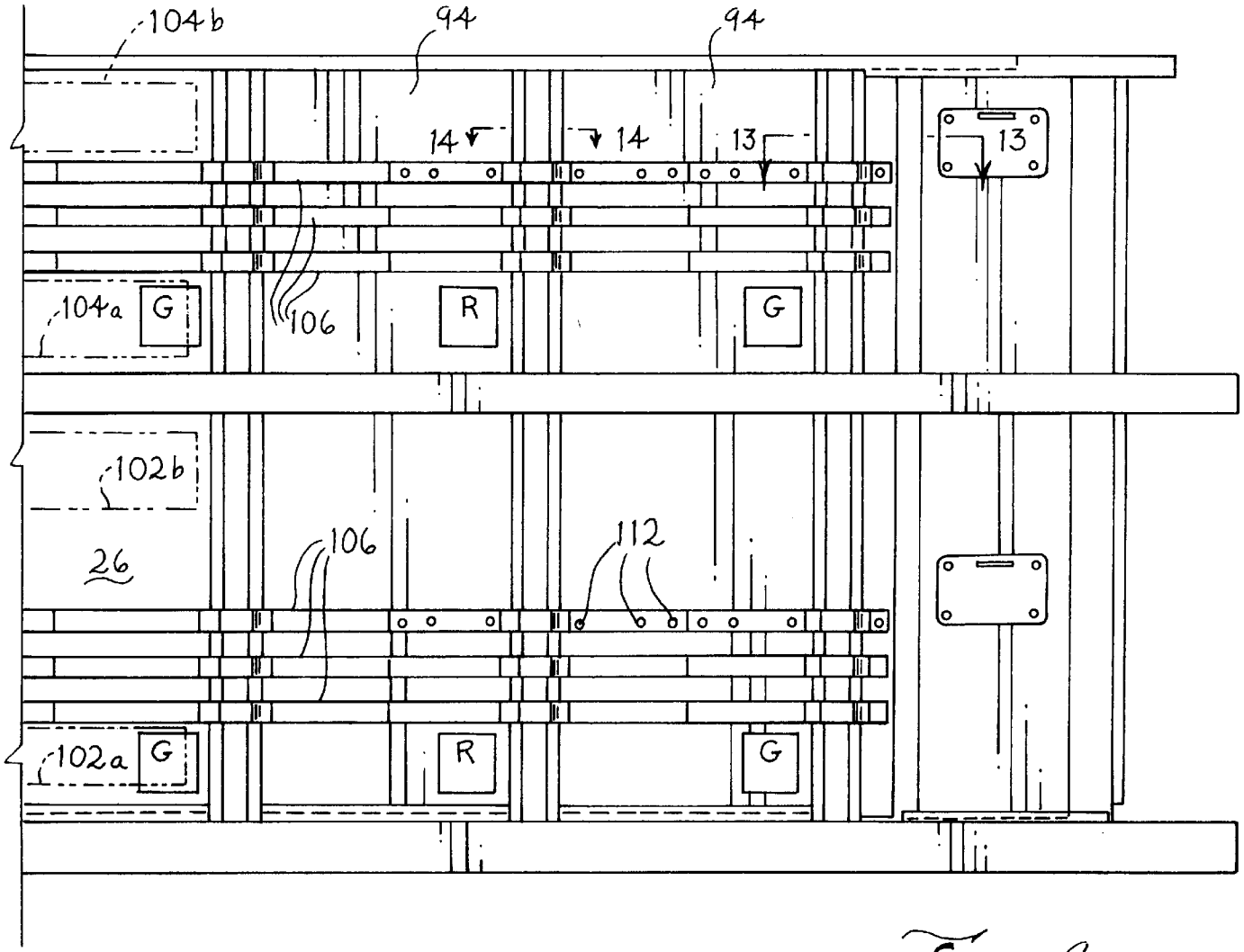
FIG. 9 is an elevational view illustrating the interior of one of the side walls of the railway car of FIG. 1.

In the illustrated embodiment, an inner edge portion 82 of each of the seal members 76 is angled relative to an adjoining intermediate portion thereof so that the inner edge portion extends parallel to the longitudinal axis of the car. With this arrangement, as the doors are brought together, the inner edge portions 82 of the respective seals meet each other initially, and the seals then begin to deform as the doors are moved closer together, until the position illustrated in FIG. 7 is reached. When the doors are brought together in their fully closed position, the respective seal members contact and press against each other to inhibit or prevent air from passing between them. The seals 76 are preferably made from a flexible, resilient material, so that they will return to their undeformed positions when the doors are opened, and will retain their resilience over an extended period of time.

The outer edges of the end doors are preferably connected to the side walls by a flexible material 84 which prevents or inhibits inflow of dust particles and the like through the gap between the outer edge 86 of the end door and the side wall 26 of the car unit. In the illustrated embodiment, the outer edge 86 of the end door is connected to the side wall 26 by a sheet of flexible material 84 which has one vertical edge 88 attached to the door and the opposite vertical edge 90 attached to the side wall. In the illustrated embodiment, the flexible material 84 is attached to a bracket 92 affixed to one of the vertical posts 38. The flexible material 84 may comprise a sheet of a flexible fabric. The portion of the door which extends above the roof rail may be connected to the roof by a smaller sheet of flexible material in a similar manner.

Side Walls

In railway cars for carrying motor vehicles, there are typically two or three levels provided, such that approximately one-half or two-thirds of the load carried by the car is supported above the floor 22 of the car. In the past, support for the upper level or levels has generally been accomplished by providing a truss along each side of the car. In the prior art auto rack cars, each truss typically comprises a series of vertical posts which are connected by horizontal members, with the structure being stiffened by knee braces, gussets, and/or other structural members which restrict the interior bore of the car through which motor vehicles are driven during loading and unloading. In the preferred embodiment of the invention, the railway car unit 20 is provided with a "clean bore" interior design from which the intrusion of knee braces, gussets, and the like, has been substantially reduced.

In typical prior art auto rack cars, the spaces between the vertical posts were largely occupied by non-load-bearing perforated panels, and there were typically gaps on the order of 1½ in. in width between the panels and the structural members. The perforated panels contributed no significant strength to the side walls.

In the illustrated embodiment of the invention, load-bearing side walls are employed to reduce the need for structural members to protrude into the car interior. To this end, each side wall 26 comprises a plurality of substantially vertical posts 38 which are connected by load bearing side wall panels 94 which function as shear plates to tie the vertical posts 38 together and bear substantial loads in the plane of the side wall. Each of the side wall panels 94 preferably extends substantially the entire height of the side wall.

Each of the posts 38 preferably comprises an outwardly opening channel 96 having flanges 98 on each side extending vertically along the post substantially parallel to the plane of the side wall. Each of the posts 38 has what is commonly referred to as a "hat shaped" cross section. Each of the side wall panels 94 preferably comprises a steel plate which is bolted or otherwise fastened to the flanges of its associated posts.

As an alternative to the illustrated hat-shaped posts, hollow tubular posts of rectangular cross-sections could be employed. It is contemplated that in other embodiments of the invention, different side wall configurations could be employed to reduce interior obstructions, including truss configurations in which knee braces and gussets are eliminated or reduced in size as compared with prior art auto rack cars.

To provide passive lighting and ventilation for the car interior, each side wall panel 94 preferably has a plurality of openings or perforations 100 formed therein.

While the illustrated perforations are circular, other shapes may alternatively be employed. The perforations are preferably large enough to avoid inadvertent closure of perforations by paint. The perforations are sized and positioned so as to provide adequate lighting and ventilation without compromising the structural integrity of the side wall, and without admitting excessive quantities of airborne particulate matter into the car interior during railway travel. To this end, the perforations are preferably grouped in horizontally extending bands along the top and bottom of each level. Along the lower level of the railway car, a first band of perforations 102a extends just above floor height, to provide lighting and ventilation for workers adjusting wheel chocks at the floor of the level, and a second group 104a extends along the top of the level, providing additional lighting and ventilation.

The upper level is similarly provided with upper and lower bands 102*b* and 104*b*. In the illustrated embodiment, each band of perforations comprises a horizontal series of rectangular groups of perforations, with each group in the series being disposed on one of the side wall panels 94. Each group is preferably spaced inward from the edges of the panel by a margin of about 6 in.

Each band of perforations preferably has a vertical dimension of between about 6 in. and 24 in. Each perforation preferably has a diameter of about ⅝ in. to 1 in., and may have a diameter of ⅞ in., for example. The centers of the perforations may be spaced about 1⅜ in. apart in each band.

The bands may extend substantially the entire length of the car, or may extend less than the entire length. Near the end doors 28 of the railway car, adequate light and ventilation are provided when the doors are open, and light and ventilation are not needed when the doors are closed. Accordingly, no perforations are provided in the three side wall panels adjacent the end doors at each end of the illustrated car. The side wall panels 94 immediately adjacent the articulation on each unit of the car may also be solid, rather than perforated, for additional strength at these locations.

Door Edge Protection

As noted above, one of the problems encountered in transporting motor vehicles in railway cars is that the edges of the vehicle doors may impact interior surfaces of the railway car when the doors are opened to permit the drivers to enter or exit. This can damage the paint on the doors of the vehicles.

The illustrated railway car addresses this in three different ways. First, as described above, interior obstructions are reduced by the use of side wall panels which function as shear plates. Secondly, as also described above, the side wall panels are substantially planar steel plates, presenting a substantially flat, vertical surface between each pair of posts in the car interior, in contrast to the interior side wall surfaces of prior art auto rack cars which include inwardly projecting flanges of side wall panels.

The third way in which the illustrated car addresses the problem is by providing a series of generally horizontally extending door edge protection strips 106 along the inside of each side wall. On each level, a plurality of door edge protection strips 106 are provided. On each level, the strips are vertically spaced from one another, and are disposed substantially parallel to one another to provide door edge protection for absorbing impacts from doors of vehicles of various sizes which may be transported in the railway car on that level.

Each of the door edge protection strips 106 preferably has a longitudinal recess 108 extending along the center of its interior surface. Openings 110 are formed in the recessed portion to accommodate fasteners for attaching the door edge protection strip to the side wall. Each of the door edge protection strips 106 preferably comprises an extrusion made of a plastic material.

Each of the openings 110 is preferably an elongated slot, elongated in the horizontal direction, to facilitate installation of the strips. The fasteners may be made of plastic or other suitable material.

Figure 15:
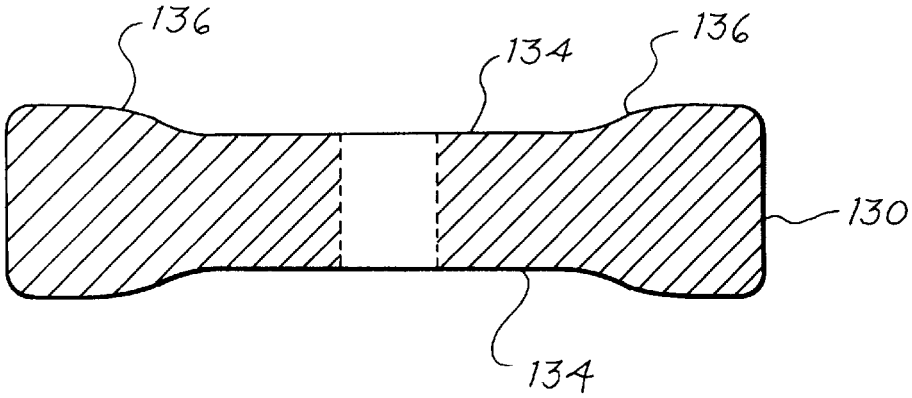
FIG. 15 is a sectional view similar to that of FIG. 11, illustrating a door edge protection strip in accordance with an alternative embodiment of the invention.
Figure 16:
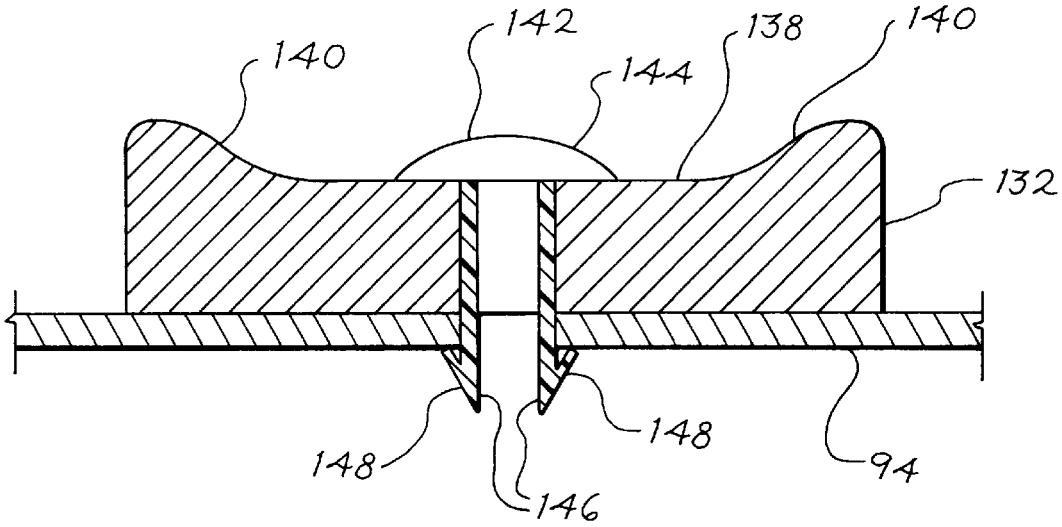
FIG. 16 is a sectional view similar to that of FIG. 11, illustrating a door edge protection strip in accordance with another alternative embodiment of the invention.

FIGS. 15 and 16 illustrate door edge protection strips 130 and 132 in accordance with additional embodiments of the invention, which may be used as alternatives to the door edge protection strip shown in cross-section in FIG. 11.

In the door edge protection strip 130 shown in FIG. 15, channels 134 are provided on both sides of the strip. Each channel 134 has outwardly dished or sloping sides 136, rather than the perpendicular sides shown on FIG. 11.

In the embodiment of FIG. 16, the door edge protection strip 132 similarly has a channel 138 with dished or sloping sides 140, but the channel 138 is disposed on one side only. The opposite side is substantially flat and planar.

In the embodiments of FIGS. 15 and 16, the gradually sloped or dished sides of the channel may provide an advantage over the embodiment illustrated in FIG. 11, in that heat treatment of the exterior surface or skin of the door edge protection strip may be more readily applied in a uniform manner. The door edge protection strips may be made of a plastic foam material, e.g., a polyethylene foam, with additives which enable a tough, resilient, flexible skin to be formed on the exterior by application of heat thereto. With a square or rectangular cross-section channel as in FIG. 11, the effectiveness of the heat treatment may be compromised, leading to weakness of the skin in the region of the channel.

As shown in FIG. 16, a plastic rivet or buttontype fastener 142 may be employed to secure the door edge protection strip to the side wall panel. This type of fastener comprises a head 144 and a pair of flexible, resilient legs 146, which are biased outwardly, and which have outward barb-like protrusions 148 at their ends to retain the fastener in place after it has been pushed through the opening.

Flexible Enclosure

To eliminate ingress of particulate laden air at the adjacent ends of the respective car units, a flexible enclosure 114 is preferably provided to join the side walls 26 and roofs 24 of the car units. The flexible enclosure may comprise one or more integral flexible members, each having a first end attached to the first car unit, and the second end attached to the second car unit, so that each of the integral flexible members spans the gap between the car units. In the illustrated embodiment, the flexible enclosure comprises a roof member 116 extending from the roof of the first unit to the roof of the second unit, and first and second side wall members 118 extending horizontally from the respective side walls of the first unit to those of the second unit. The side wall members 118 are joined to the roof member 116, and are preferably sealed thereto.

Each of the integral flexible members is preferably formed with an accordion-pleated configuration to permit it to compensate for pivoting of the car units relative to each other. For security purposes, the flexible enclosure is preferably made of a cut-resistant material. At the bottom of each of the side wall members 118, the flexible enclosure has portions which extend partially under the floors of the respective car units.

The flexible enclosure may comprise a multipleply wire fabric, comprising a first layer having wires oriented in a first direction embedded therein, a second adjacent layer having wires oriented in a second direction, generally perpendicularly to the first direction, and if desired, one or more additional layers, with the orientation alternating from layer to layer. Alternatively, the enclosure may comprise a wire grid embedded in a polymer matrix.

Each of the enclosure members is preferably molded from a synthetic rubber, natural rubber, elastomer, or polymer, with steel reinforcing wires embedded therein. In particular, the enclosure may be made of a nonflammable, elastomeric material which is known commercially as Neoprene.

Coated Roof

Corrugated galvanized steel roofs have been used for many years on auto rack cars. In accordance with the preferred embodiment of the invention, each of the car units has a coated roof 22. The coating preferably comprises a polymeric material such as polyvinyl chloride, and the coating is preferably applied to both the top and bottom surfaces of the roof to improve resistance to corrosion. To avoid undue heating of the interior of the railroad car during exposure to sunlight, the color of the coating is preferably white, which enables the coating to reflect heat from sunlight.

Conclusion

From the foregoing it should be appreciated that the invention provides a novel and improved railway car for carrying motor vehicles. While a preferred embodiment of the invention is described above, the invention is not limited to the preferred embodiment. The invention is further described and more particularly pointed out in the following claims.

What is claimed is:

1. A railway car capable of transporting automobiles in commercial rail service, said car comprising a floor, a roof, a pair of upstanding side walls, a pair of end doors, and at least one upper deck spaced above the floor of the car so that automobiles may be supported on at least two levels;

each of said upstanding side walls comprising a plurality of substantially vertical posts supporting said at least one upper deck and roof, and a plurality of side wall panels connected to said substantially vertical posts;

said side wall panels functioning as shear plates to tie said vertical posts together and to bear substantial loads in the plane of said side wall;

each of said side wall panels extending substantially the entire height of said side wall, and some of said side wall panels having a plurality of separate groups of perforations for ventilation and lighting formed therein, with other portions of the side wall panels being imperforate to reduce admission of airborne particulates said groups of perforations including a horizontal series of groups along the bottom of at least one level to provide lighting and ventilation for workers adjusting wheel chocks at the floor of the level;

said groups of perforations being spaced inward from the edges of the panel and being spaced vertically from one another in each panel.

2. A railway car in accordance with claim 1 wherein each of said groups of perforations is substantially rectangular in shape.

3. A railway car in accordance with claim 2 wherein each of said side wall panels comprises a steel plate having a first edge rigidly attached to one of said posts, and a second edge rigidly attached to another of said posts.

4. A railway car in accordance with claim 3 wherein each of said groups has a vertical dimension of between about 6 in. and about 24 in.

5. A railway car in accordance with claim 4 wherein each of said perforations has a diameter of about ⅝ in. to 1 in.

6. A railway car in accordance with claim 5 wherein said groups of perforations are arranged in horizontal series.

7. A railway car in accordance with claim 6 wherein said groups of perforations are arranged in no more than four horizontal series.

* * * * *